United States Patent [19]

Loder

[11] Patent Number: 4,562,938

[45] Date of Patent: Jan. 7, 1986

[54] SHEET DISPENSER

[75] Inventor: Harry A. Loder, Mahtomedi, Minn.

[73] Assignee: Minnesota Mining and Manufacturing Company, St. Paul, Minn.

[21] Appl. No.: 595,235

[22] Filed: Apr. 2, 1984

[51] Int. Cl.[4] ..... B65H 1/00

[52] U.S. Cl. ..... 221/46; 221/63

[58] Field of Search ..... 221/26, 45, 46, 33, 221/197, 284, 282, 286, 281, 47, 48, 51, 53, 54; 206/39.7, 39.8, 39.3, 39; 312/50, 60

[56] References Cited

U.S. PATENT DOCUMENTS

| | | | |
|---|---|---|---|
| 297,217 | 4/1884 | Abbott | 206/39.8 |
| 2,802,567 | 8/1957 | Covel | 221/48 |
| 2,840,267 | 6/1958 | Nelson | 221/48 |

*Primary Examiner*—Joseph J. Rolla
*Assistant Examiner*—David H. Bollinger
*Attorney, Agent, or Firm*—Donald M. Sell; James A. Smith; John C. Barnes

[57] ABSTRACT

A dispenser for sheet material affords the clamping action against the sheet partially dispensed from the container to maintain it in a position where it can be grasped and dispensed. The dispenser comprises a cartridge for a stack of sheet material which stack is formed by releasably adhering successive sheets adjacent opposite edges to permit the dispensing of one sheet and the grasping of the next adjacent sheet at the opening to dispose an edge of such sheet to permit the subsequent dispensing of the next sheet. The exit opening enlarges under the dispensing force applied to each successive sheet but removal of the force allows the side walls of the cartridge to return from a pivoted position to the original position, closing the opening and grasping the sheet therebetween. The cartridge is disposed within a housing which contains the cartridge during the movement of the upper or top wall while the sheets are being dispensed.

10 Claims, 8 Drawing Figures

SHEET DISPENSER

BACKGROUND OF THE INVENTION

1. Field of the Invention

This invention relates to an improved dispenser for a stack of sheet material, permitting the dispensing of one sheet at a time from a stack of sheets throughout the stack with the next successive sheet being disposed for easy grasp. In one aspect the invention relates to an improved dispenser for adhesively joined sheets which will permit dispensing sheets serially from a stack without the next to be dispensed sheet falling back into the cartridge upon separation therefrom of the dispensed sheet.

2. Description of the Prior Art

This invention is directed to an improvement in dispensers for dispensing individual sheets from a stack of sheets releasably joined together and disposed within a cartridge from which they are to be dispensed.

U.S. Pat. No. 4,416,392, issued Nov. 22, 1983, to Daniel D. Smith, and assigned to the assignee of this application, is directed to a dispenser for sheets stacked together in a manner similar to the stack of sheets for use with the present invention. In the Smith patent a dispenser is shown which is in the form of a shallow box from which sheets may be dispensed individually. The number of sheets which may be dispensed from a box is limited to a stack having a height not significantly greater than three-fourths the length of a sheet such that the sheets being dispensed, when they near the bottom of the stack, will not fall back into the cartridge when separated from the sheet being dispensed. A second embodiment disclosed in the Smith patent is a dispenser wherein the stack of sheet material was urged towards the dispensing opening such that the sheets were generally maintained in the same position adjacent the opening until the last of the sheets in the stack were dispensed.

The dispenser of the present invention is unique in that it provides, in a rather uncomplicated and inexpensive manner, a guaranteed positioning of the next sheet to be dispensed in the dispensing opening without regard, necessarily, to the numbers of sheets in the stack placed in the cartridge.

The idea of providing a "pop-up" dispenser for dispensing sheets of notepaper is very desirable and, as is often the case, it is desirable to be able to grab a sheet of notepaper from the stack when only one hand is available to grasp the sheet and to separate it from the stack. With sheets which are in tablet form, wherein the sheets are bonded together by a gum adhesive at one edge or are to be separated along a perforation from the other sheets in the tablet, such as dispensing procedure with one hand is impractical, if not impossible. The dispensing of sheets of notepaper individually with one hand is possible when the sheets are placed in a pad such that the sheets are adhered together along alternately opposite edges by a peelable medium. One such medium is a narrow band of a repositionable acrylate copolymer microsphere-structured pressure-sensitive adhesive, such as that described in U.S. Pat. No. 3,691,140, assigned to the assignee of this application.

While both of the dispensers disclosed in the Smith patent, U.S. Pat. No. 4,416,392, function excellently for their intended use, the dispenser with the fixed opening and resembling a box to contain the sheets, is limited in the number of sheets which can be dispensed from a pad before experiencing unwanted multi-sheet dispensing and the sheet fall back. This multi-sheet dispensing is the result of a decrease in the amount of dispensing resistance applied to the pad by the exit opening as the pad is consumed. This problem becomes more severe as the height of the pad increases since a point is reached where the sheets do not need to buckle but merely to bend to allow the edges of the sheets which are joined to be drawn through the exit opening. For example, if the stack of sheets have a cube format where the pad height may exceed the sheet length, a fixed exit opening is not practical.

A second problem which is prevalent with the fixed exit opening design is that no means is provided to prevent the top sheet of the pad from falling back through the exit opening as the sheets are being dispensed. When this problem occurs the user is required to fish the end of the pad back through the exit opening, thus defeating the object of the dispenser. This problem also increases in severity as the pad height increases.

The dispenser construction that utilizes the spring elevated base which moves the stack of sheets progressively toward the opening as the sheets are dispensed off the top of the stack requires a number of parts, i.e. a base, a spring, a platform upon which to stack the sheets, and a containment housing having the opening through which the sheets are dispensed.

The present invention overcomes the problems associated with the dispensers of the earlier Smith patent by (1) providing an exit opening which is movable and self-adjusts to compensate for the varying resistance requirements encountered during the dispensing of individual sheets from the pad; and (2) providing a means to grip the sheets, thus preventing the falling back of the sheets through the exit opening. This performance improvement is accomplished without the need for a mechanical device within the dispenser.

SUMMARY OF THE INVENTION

The dispenser of the present invention comprises a cartridge shaped to support a stack of sheets, which cartridge is then readily adapted to be placed within a magazine which contains the cartridge and the sheets associated therewith and protects them from being displaced or scattered.

The cartridge is formed from a blank, cut from box board, comprising a rectangular base portion with two opposite free edges and joined along a third edge defined by a fold line to which is joined a pair of side panels connected to a pair of cover members extending generally parallel to the edges of the sheets which are adhered together, and which cover members are connected to side panels on the opposite side of the stack equal to the first side panels which opposite side panels may be joined to the fourth edge of the base. The cartridge provides an exit opening between the cover members which is movable upon a force being exerted inside of the cartridge and which self-adjusts to compensate for the varying resistance requirements encountered during sheet dispensing, and providing a means to grip the sheets which are not to be dispensed, thus preventing the falling back of the sheets through the exit opening of the dispenser.

The cartridge fits within a magazine or containment housing which is formed of any suitable material having a generally rigid structure. The magazine is shaped to receive the cartridge and is formed with an opening extending parallel to the opening in the cartridge through which the sheets may be dispensed. The magazine has the cover portions adjacent the opening disposed at an angle with the two top portions converging toward the opening to permit movement of the upper portion of the cartridge within the magazine during the dispensing of the sheets.

The magazine is preferably provided with a weighted base such that the weight of the magazine exceeds the force required to remove one sheet from the cartridge and separate the sheet from the next adjacent sheet by peeling the sheets apart at the adhesive bonded edge.

The cartridge essentially consists of a cover which extends across the stack of sheets with a dispensing opening extending generally parallel to the edges of the sheets which edges are joined together by a suitable medium coated onto each sheet along an edge with the coating on adjacent sheets being positioned along opposite edges of the sheets. The medium must have greater shear strength than peel strength. Side members are joined to the cover members and the side members are provided with a fulcrum about which the cover members and side members may pivot to move the edges of the cover members defining the dispensing slot away from each other in a translational manner, permitting the dispensing of a sheet and movement of the two edges toward one another to grasp the next successive sheet to position it for dispensing. The mating edges of these two cover members defining the dispensing opening may be parallel edges or are improved by the use of undulated edges formed to have interference between the cover members at the opening to increase the holding force on the sheet.

DESCRIPTION OF THE DRAWING

The present invention will be further described with reference to the accompanying drawing wherein.

DESCRIPTION OF THE PREFERRED EMBODIMENTS

Figure 1:
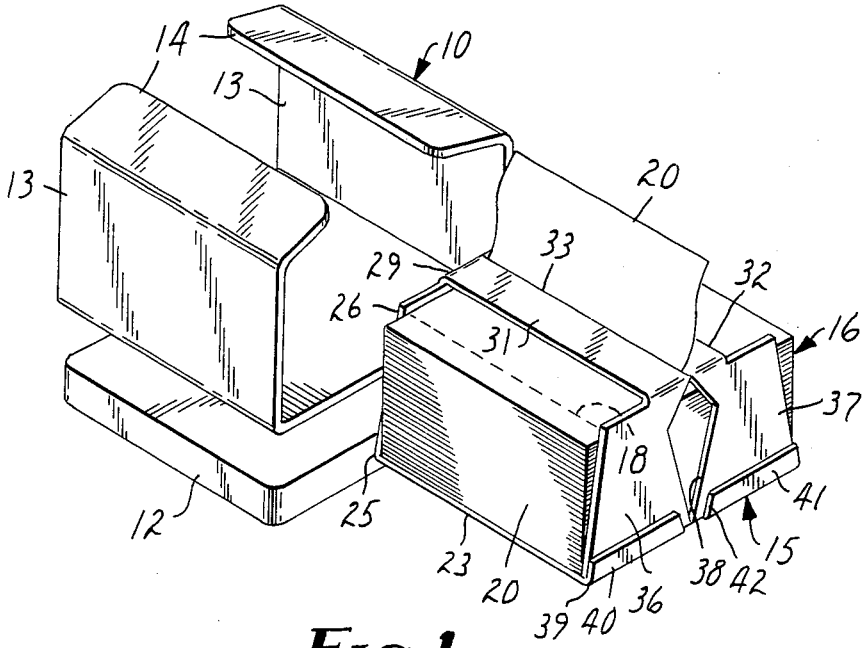
FIG. 1 is a perspective exploded view of the magazine, the weighted base for the magazine, the cartridge, and a stack of sheets with each sheet adhered by a narrow band of relatively easily releasable material coated on the lower side of each sheet along one edge thereof and joined to the next adjacent sheet along alternately opposite edges of the successive sheets.

Referring now to the drawing there is shown in FIG. 1 a magazine 10 or decorative housing which may be adhered to a weighted base 12, and which is designed for providing a container for a replaceable cartridge 15 containing a stack 16 of sheet material 20. Each sheet 20 is a rectangular sheet of paper or other material releasably adhered along alternately opposite edges to the next adjacent sheet. The sheets are releasably adhered by a coating of a pressure-sensitive adhesive which is readily releasable and permits repositioning of the sheet. The coating is preferably a narrow band of adhesive coated along one bottom edge of each sheet with each sheet 20 in the stack having the narrow band of adhesive coated on alternately opposite edges of the successive sheets. The adhesive material has greater shear strength than peel strength to permit dispensing. The narrow band of adhesive is 0.25 to 0.75 inch (6 mm to 19 mm) wide and is indicated in FIG. 1 by the dotted line 18 for the upper sheet 20 of the stack of sheets 16.

The housing 10 is a generally rigid structure and may be formed of metal, wood, plastic, or fiber stock material having a strength great enough to withstand the lateral and vertical movement of the stack of sheet material 16 in the cartridge during the dispensing sequence of successive sheets from the cartridge.

The magazine 10 should be secured to a suitable surface or provided with sufficient weight to counteract the force exerted against each sheet as it is pulled from the cartridge 15. The weight may be afforded by a metal plate adhered to the base of the magazine or the base 12 may be formed with the magazine and filled with sand, metal filings or other ballast material to provide the desired weight. The weight of the magazine is important to permit dispensing of the successive sheets 20 from the cartridge 15 with one hand such that one does not have to hold the magazine in place as the sheets are pulled from the magazine. The magazine 10 has vertical side walls 13 joined to inclined upper top wall members 14 which are separated to define the sheet dispensing opening.

The cartridge 15 contains the stack of sheet material 16 and is designed to provide the dispensing resistance required during dispensing of the individual sheets 20. The cartridge 15 is designed to restrict unwanted multi-sheet dispensing or loss of the free end of the next sheet in the stack after one sheet is dispensed and peeled from the free end of the next adjacent sheet. This has hereinabove been referred to as falling back through the exit opening at the completion of the dispensing sequence.

The cartridge 15 is designed to have a "clam shell" movement at the dispensing slot formed in the cover portion of the cartridge. The slot is formed by two edges in mating engagement with each other when the cartridge is at rest to clamp therebetween a sheet 20. The slot provides a self-adjusting exit opening that opens a proportional distance to compensate for the force exerted upon the cartridge during dispensing of a sheet 20 from the cartridge. The clamping action of the cover at the exit opening is dependent upon the weight of the pad, the stiffness of the cartridge material or the resilience of the cartridge material, or a combination of the same, which exert a spring force tending to position the mating edges of the cartridge in contact with each other.

The cartridge may be formed of different materials, including metal, plastic, paper, fiberboard, or wood, it being understood that the thickness and design may vary and are dependent on the materials selected. Critical factors which must be considered in the selection of material in the design of the cartridge are the spring action of the cartridge base, the static width of the exit opening, the durability of the material used for the side supports, and the stiffness and resilience of the cover members defining the exit opening.

Figure 2:
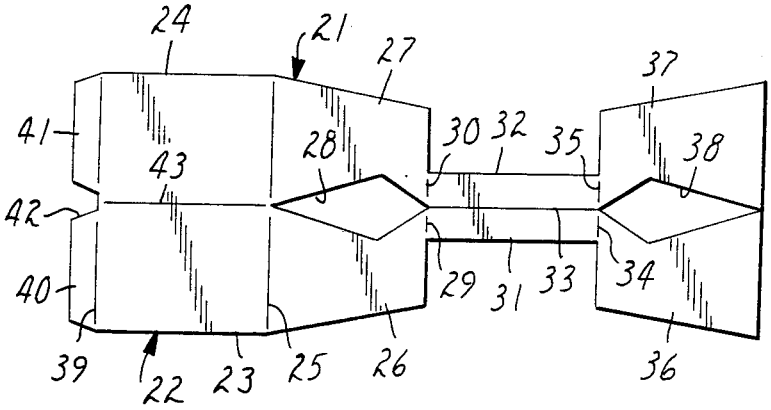
FIG. 2 is a plan view of a box blank for forming the cartridge.

Referring now to FIG. 2, there is illustrated the preferred form of blank from which the cartridge can be formed. The blank 21 comprises a base 22, having two free edges 23 and 24, joined together by a third edge 25, defined by a fold line. A pair of side members 26 and 27 are joined along the fold line 25 to the base 22 and extend perpendicular therefrom. Side members 26 and 27 are separated by a cut-out 28, and the opposite edges of the side members are joined by fold lines 29 and 30 to the cover members 31 and 32, each of which are provided with a mating edge defining the exit opening 33. The other ends of the cover members 31 and 32 are joined along fold lines 34 and 35 to side members 36 and 37 which are substantially identical or mirror images to the side members 26 and 27, and are also separated from each other by a cut-out 38. The free ends of the side members 36 and 37 can be joined to the fourth edge 39 of the base 22. Typical in box construction using fiberboard or box board is the use of tabs such as the tabs 40 and 41 and spots of adhesive as means for adhering the side members 36 and 37 to the edge 39 of the base 22. The blank forms a sleeve or shell which is rectangular in cross-section. As an alternative to the placement of the tabs 40 and 41 on the base 20, they could be added by fold lines to the ends of side members 36 and 37, but it is important to leave a weakened region in the base 22 transversely of the center line thereof as defined by the notch 42 between the tabs 40 and 41 and the cut-out 28.

Figure 3:
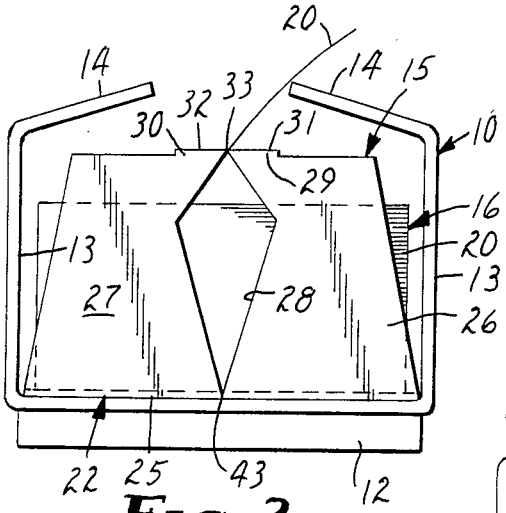
FIG. 3 is a side elevational view diagrammatically showing the cartridge in the magazine with a sheet positioned to be dispensed.
Figure 4:
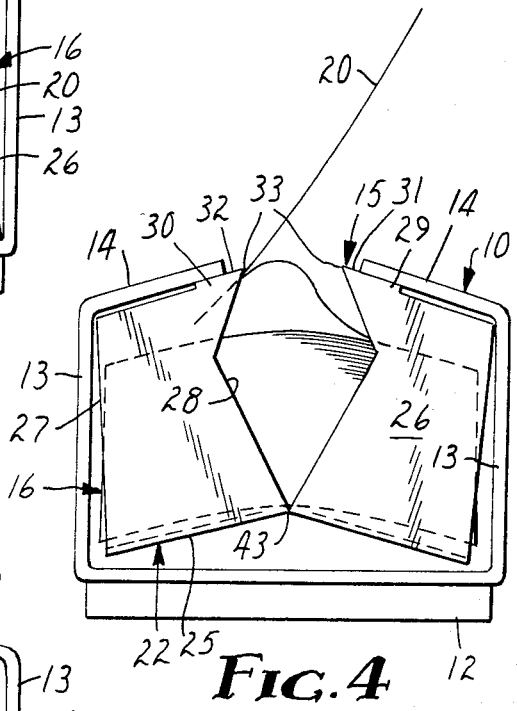
FIG. 4 is a side elevational view diagrammatically showing the sheet of FIG. 3 being dispensed from the cartridge.

Referring now to FIG. 3 there is shown the assembly of the magazine 10 on the weighted base 12, with the stack of sheet material 16 in the cartridge 15, with the cartridge 15 disposed within the magazine 10, and the uppermost sheet 20 having its free end extending outwardly from the exit opening 33 of the cartridge. As force is exerted on the edge of the sheet 20 to withdraw the same from the cartridge, the removal force begins by pulling the sheet 20 which is adhered by the band of adhesive to the next adjacent sheet in the stack 16. The dispensing force will place a force against one edge of the cover defining the exit opening 33 and will buckle the next adjacent sheet as indicated in FIG. 4. This force will lift the cartridge and then it will separate the cover members to separate the edges at the exit opening. Separation of the edges will cause the side members to pivot about the transverse center line 43 in FIGS. 2, 3, 4, 5 and 6, of the base defining a hinge for the side members 26, 27, 36 and 37. The cover members 31 and 32 move from a spaced position toward the inclined top members 14 of the magazine 10.

Figure 5:
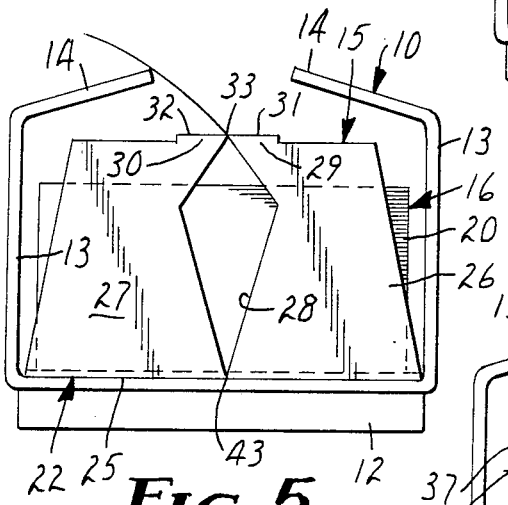
FIG. 5 is a side elevational view after the sheet is dispensed, showing the cover member closed on the next successive sheet.

When the sheet 20 is finally removed from the cartridge, the free end of the next successive sheet is also removed. At this point the greater amount of dispensing force has been exerted. The stack of sheets thereafter will fall back to its original position against the base 22 of the cartridge. The force required to peel the sheets apart where adhered along an edge to separate the dispensed sheet 20 from the free end of the next successive sheet is less than the dispensing force and will not exceed the combined weight of the stack and the resilience of the material of the cartridge which serve to clamp said next sheet between the edges defining the exit opening. The next successive sheet is now clamped at the exit opening as the cartridge has closed the exit opening upon this sheet. This is illustrated in FIG. 5.

Figure 6:
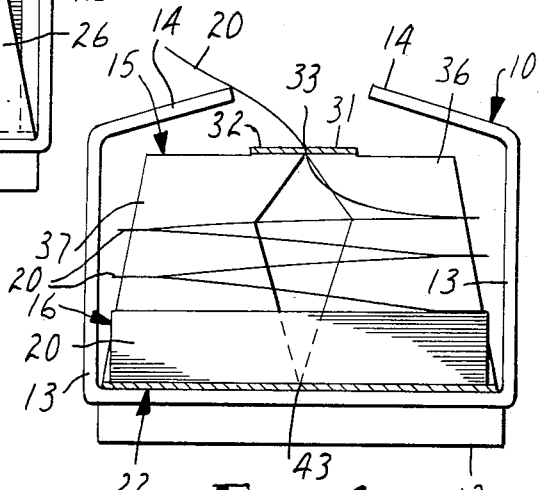
FIG. 6 is a side elevational view partially in section showing diagrammatically the cartridge and sheets after two-thirds of the sheets have been dispensed.

As the sheets are successively dispensed from a cartridge, the stack of sheets is depleted, and if the sheets were all to fall back upon the stack, it may be such that the height of the side members 36 and 37 exceeds the dimension of the sheet material such that the free edge of the next sheet to be dispensed would fall back into the cartridge. FIG. 6 illustrates the position of the sheets after dispensing one sheet. The stiffness of the sheets and the width of the material adhering the sheets together will hold them separated. This positioning of the sheets, which allows the desired dispensing throughout the stack can be aided by the use of means for supporting the edges of the sheets. An example is louvers or shelves built into the cartridge as will later be explained.

Figure 7:
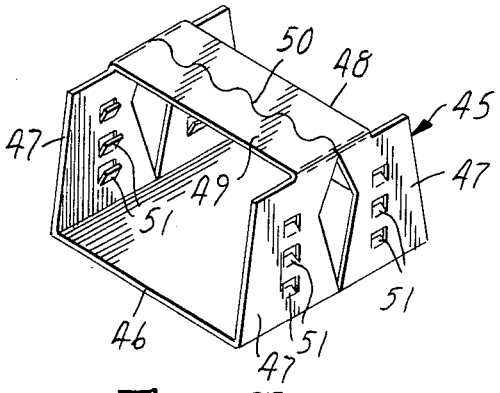
FIG. 7 is a perspective view of a second embodiment of the cartridge.

Referring now to FIG. 7 there is shown a second embodiment of the cartridge 15 wherein the mating edge of the cover members defining the exit opening are formed by undulated edges which define a dispensing opening or slot across the upper surface of the cartridge. The cartridge is generally indicated by the reference numeral 45 having a base 46 and side panels 47. Side panels 47 are joined at one edge to the base 46 and extend upwardly therefrom and are joined at the upper ends to the two cover members 48 and 49 which are separated by the edges 50 which are scalloped and mate to form an edge which would grasp a sheet 20. Also provided in the cartridge 45 are louvers 51 which are cut from the side walls 47, with the portion cut on three edges being urged inwardly to serve to support edges of the sheets 20 adjacent the band of adhesive material to hold the sheets in a raised position above the stack as the sheets are dispensed toward the bottom of the stack. The undulated, i.e. saw-tooth, wavy, square waved or scalloped edge 50 at the exit opening increases the clamping forces on the sheet held at the exit opening as the outermost edges may overlap as must as 0.5 inch (12.7 mm) to grasp the sheet at the opening.

Figure 8:
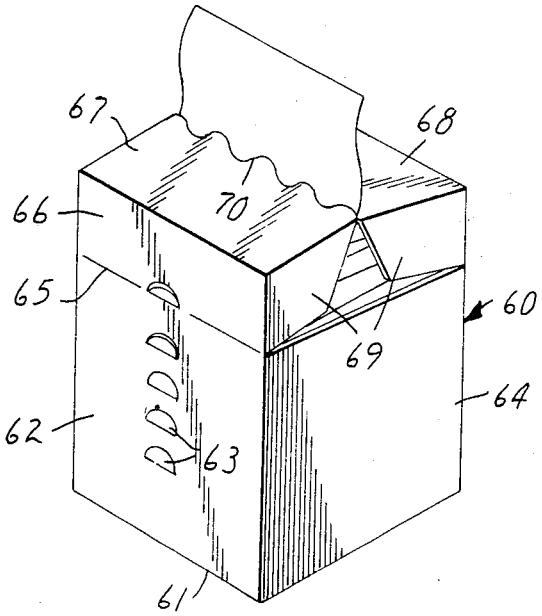
FIG. 8 is a perspective view of a third embodiment of the cartridge.

Referring now to FIG. 8, a further cartridge design 60 is disclosed which has the appearance of a box-like container with a rectangular base portion 61 having four side walls perpendicular to a base wall to receive a stack of sheet material. A pair of opposite side walls 62 are formed with louvers 63 to support the edges of the sheet material as the lowermost sheets in a stack in the cartridge 60 are being dispensed. The upper edges of the side walls 62 (only one of which is shown in FIG. 8) extend above the other two opposite side walls 64. The extended wall portions 66 pivot at lines 65 in relation to the side walls 62. The extensions 66 are joined to cover members 67 and 68 and side panel members 69 are formed as gusset plates to secure the cover members 67 and 68 to the extended portions 66 such that the side members 69 are pivoted about the pivot or hinge defined at line 65 to provide the clam shell effect and translatory movement of the mating edges 70 of the two cover members 67 and 68.

Having thus described the present invention with reference to several embodiments of the same, it will be appreciated that changes in form may be made in the parts without departing from the spirit or scope of the invention, all as defined in the appended claims.

I claim:

1. A dispenser for sheets of material releasably adhered together along opposite edges of adjacent sheets so the sheets in a stack have an accordion appearance and can be peeled apart, said dispenser comprising a cartridge adapted to fit about a stack of rectangular sheet material, said cartridge comprising two cover portions with adjacent edges in mating relationship and extending in a direction generally parallel to and centrally of the opposite edges of a stack of sheet material, each cover portion being joined to a pair of side members at the ends of said edges, said side members extending from said cover portions toward pivot means for affording translational separation of said edges upon application of a lifting force at said mating edges.

2. A dispenser for sheets according to claim 1 wherein said cover portions have undulated mating edges wherein areas of one edge extend past the outermost edge of the other edge.

3. A dispenser for sheets according to claim 1 wherein said cartridge fits into a magazine.

4. A dispenser for sheets according to claim 3 wherein said magazine includes weight means for weighting said magazine sufficiently to exceed the sheet dispensing force.

5. A dispenser for sheets according to claim 3 wherein said magazine has top members inclined and separated to define a dispensing opening.

6. A dispenser for dispensing serially successive sheets from a stack of sheets wherein each adjacent sheet is releasably adhered to the next adjacent sheet along a narrow band positioned at opposite edges of each successive sheet, said dispenser comprising cartridge means shaped for loosely fitting about a said stack of sheets and comprising a pair of cover portions extending over said stack with the adjacent edges of said cover portions extending generally parallel to said opposite edges of said sheets and in mating relationship, and a pair of side members extending generally perpendicular to each cover portion with one side member at one end of each cover portion and pivot means defining a pivot axis for said side members to afford translational separation of said mating edges of said cover portions and magazine means for receiving said cartridge and a said stack of sheets, said magazine means having an open rectangular slot disposed in spaced relationship above said cover portions to afford movement of said cover portions to separate said mating edges.

7. A dispenser according to claim 6 wherein said magazine means include means for holding said magazine means in place during dispensing movement of sheets from a said stack.

8. A dispenser according to claim 7 wherein said means for holding said magazine means comprises a weight.

9. A dispenser according to claim 6 wherein said cartridge means comprises means for supporting edges of sheets separated from said stack and moved toward said cover portions.

10. A dispenser according to claim 6 wherein said mating edges are undulated edges.

* * * * *